US006976804B1

(12) United States Patent
Asplin

(10) Patent No.: US 6,976,804 B1
(45) Date of Patent: Dec. 20, 2005

(54) METHOD OF REPAIRING DAMAGED CONCRETE SLABS

(76) Inventor: Charles Lee Asplin, 3268 Longfellow Rd., Fargo, ND (US) 58102

( * ) Notice: Subject to any disclaimer, the term of this patent is extended or adjusted under 35 U.S.C. 154(b) by 0 days.

(21) Appl. No.: 10/649,383

(22) Filed: Aug. 26, 2003

(51) Int. Cl.[7] ..... E01C 23/10
(52) U.S. Cl. ..... 404/78; 405/267
(58) Field of Search ..... 405/266, 267, 405/272, 287.1, 302.4; 404/78

(56) References Cited

U.S. PATENT DOCUMENTS

| | | | | |
|---|---|---|---|---|
| 1,915,032 | A * | 6/1933 | Poulter | 404/78 |
| 1,943,914 | A * | 1/1934 | Fiock | 404/78 |
| 1,976,857 | A * | 10/1934 | Poulter | 404/78 |
| 2,007,457 | A * | 7/1935 | Peters | 404/108 |
| 2,041,266 | A * | 5/1936 | Poulter | 404/78 |
| 2,074,756 | A * | 3/1937 | Poulter | 404/108 |
| 2,286,761 | A * | 6/1942 | Poulter | 404/108 |
| 4,092,832 | A * | 6/1978 | Mattson | 405/229 |
| 4,194,726 | A | 3/1980 | Hance | 254/133 |
| 4,420,957 | A | 12/1983 | Weber | 72/1 |
| 4,470,719 | A * | 9/1984 | Dziark et al. | 404/75 |
| 4,563,110 | A * | 1/1986 | Langenbach et al. | 405/230 |
| 4,567,708 | A | 2/1986 | Haekkinen | 52/743 |
| 4,646,482 | A | 3/1987 | Chitjian | 51/424 |
| 4,839,969 | A | 6/1989 | Hahn | 34/169 |
| 4,850,752 | A | 7/1989 | Carey-Yard | 406/153 |
| 4,878,320 | A | 11/1989 | Woodson | 51/320 |
| 4,962,913 | A | 10/1990 | Stewart | 254/269 |
| 5,081,799 | A | 1/1992 | Kirschner et al. | 51/410 |
| 5,083,402 | A | 1/1992 | Kirschner et al. | 51/319 |
| 5,230,185 | A | 7/1993 | Kirschner et al. | 51/410 |
| 5,239,788 | A | 8/1993 | Woodson | 51/436 |
| 5,325,638 | A | 7/1994 | Lynn | 51/320 |
| 5,577,446 | A | 11/1996 | Perry et al. | 104/2 |
| 5,860,763 | A | 1/1999 | Asplin | 404/78 |
| 6,068,425 | A * | 5/2000 | Fershtut | 404/78 |
| 6,419,127 | B1 * | 7/2002 | Fershtut | 404/78 |
| 6,558,071 | B1 * | 5/2003 | Sproules | 404/78 |

FOREIGN PATENT DOCUMENTS

| | | | |
|---|---|---|---|
| DE | 38 38 534 | * | 5/1990 |

* cited by examiner

*Primary Examiner*—Gary S. Hartmann
(74) *Attorney, Agent, or Firm*—Curtis Harr

(57) ABSTRACT

A method of repairing concrete slabs that have become uneven and dangerous is provided that employs lime sludge that is injected under pressure into the space between the lower surface of the damaged concrete slab and the underlying ground to raise that slab back into a level orientation. Once this has been accomplished, any remaining space below the slab is filled in with well dried sand blown in under pressure.

14 Claims, 5 Drawing Sheets

FIG 2
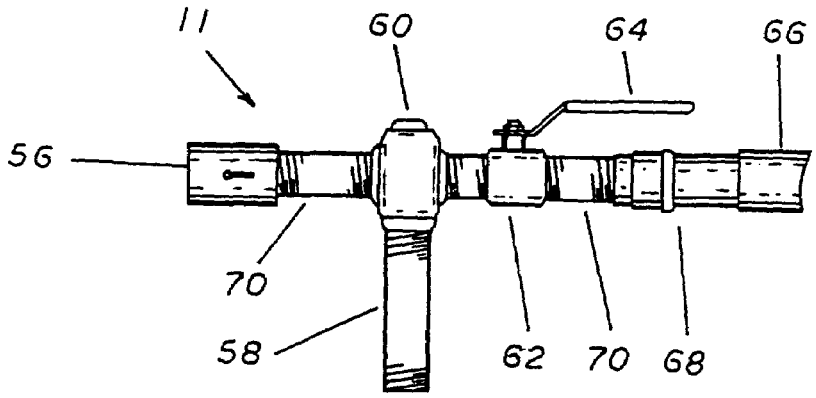
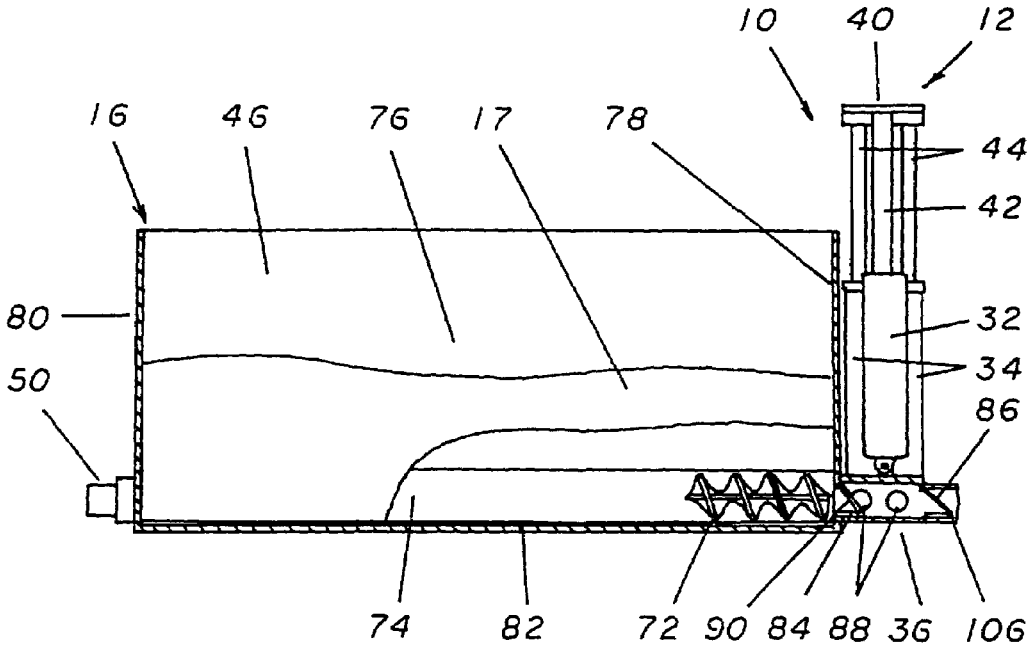
FIG 3

FIG 6
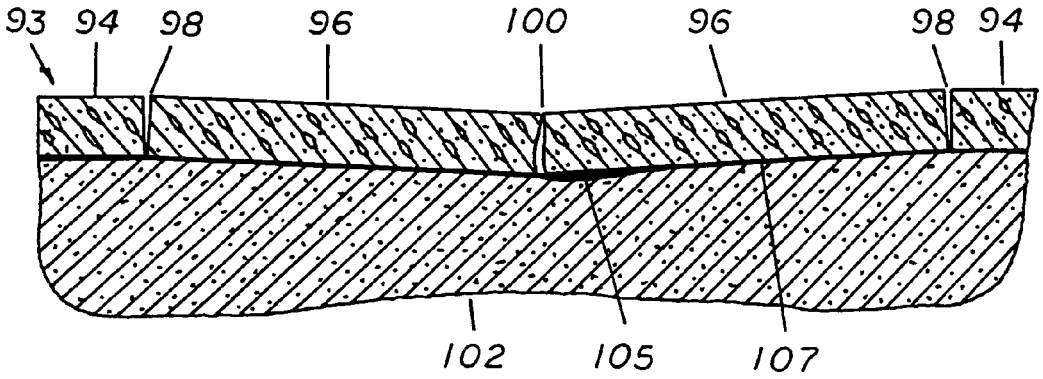
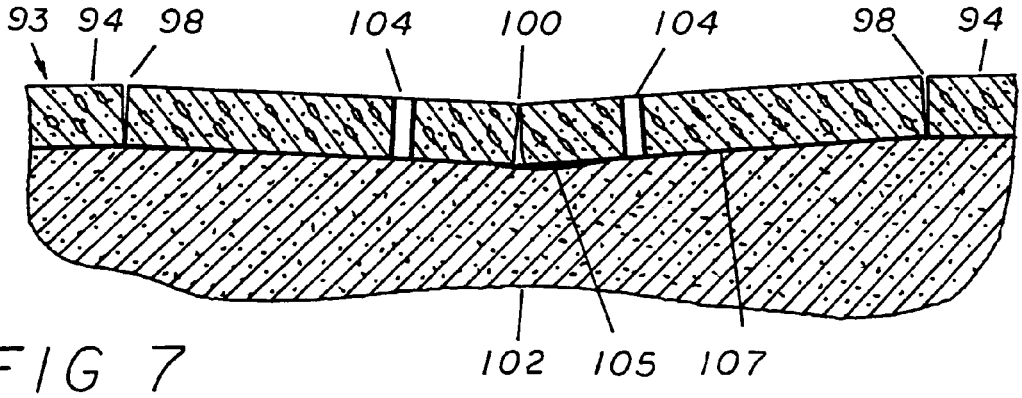
FIG 7
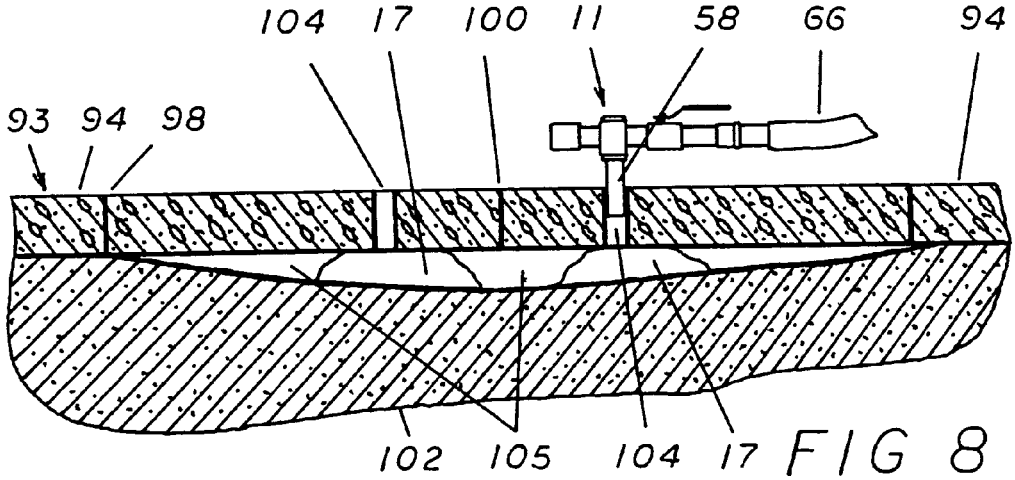
FIG 8

METHOD OF REPAIRING DAMAGED CONCRETE SLABS

BACKGROUND OF THE INVENTION

The present invention relates to a method of repairing an existing section of concrete slab which has had portions settle into the ground so as to become uneven over time. More specifically, to a method of carefully raising a section of settled cement slab so as not to damage the section and allow for the injection of pressurized mason's sand into the cavity created between the bottom of the uneven cement slab and the settled ground.

Regardless of the care and skill used in the initial construction, concrete slabs tend to become misaligned over time due to different rates of settlement of the earth. Uplift from freeze/thaw cycles or tree root lifting are also common causes of slab misalignment. These problems cause cracks in the cement slab to develop and can also cause step-like structures to occur between sections of the slab. The end result of this condition is the creation of hazards to its users and liability for those who are responsible for their care. Additionally, the uneven cement slabs are extremely difficult to clear of snow and ice during the winter months in the northern areas of the United States, thus creating further hazards and liabilities for their users and owners.

In the past, there was a number of ways these problems were solved. One of these was to completely remove the damaged section of cement slab and then re-pour it. The problem with this method is that although it works very well, it is time consuming and very expensive. The re-pour method also results in a checkerboard looking cement slab as the new portions are often a very different color from the older weathered sections. Another method that has been used with the step formation problem is to construct concrete or tar ramps from the lower section of the cement slab to the upper. The problem with this method is that it still leaves uneven slab surfaces that are hazardous and difficult to maintain.

Finally, another method that is often used is mud jacking. In this repair method a hole is drilled through the uneven slab and wet mud is pumped under the slab until the slab becomes level. The first problem with this method is that the mud commonly used in this process is not viscous enough to provide an adequate amount of force to the cement slab to lift it enough to effectuate the repair. Another problem with the mud jacking method is that it requires that there be a substantial open area, or settle cavity, between the lower surface of the concrete slab on the underlying ground. Finally, the use of wet mud makes for an ineffectual repair as it tends to settle over time while drying resulting in a cement slab surface that retains the uneven condition that was intended to be repaired.

More recently, a number of patents have issued that attempt to deal with this problem in an effective and cost efficient manner. In U.S. Pat. No. 4,962,913, Stewart, Oct. 16, 1990, a method of lifting and repairing such damaged sidewalks is provided. The problem with this device is that by nature of its construction, a heavy frame supported by four wheels, it is large and cumbersome in operation. Further, this device requires the even lifting of a given slab in only small sections at a time, as one portion of the device rests on an un-lifted portion of the sidewalk. In U.S. Pat. No. 4,982,930, Stewart, Jan. 8, 1991, the same inventor attempted to resolve the short comings of his prior art by lightening the frame and removing the wheels. However, the resulting apparatus is still large and cumbersome in its operation. Additionally, these solutions are not capable of raising large sections of cement slabs and are therefore limited in their applications.

Therefore, from the foregoing discussion it can be seen that it would be desirable to provide a means of leveling existing cement slabs in an inexpensive manner that is highly portable, easily used and which also results in repaired slabs that are not subject to the settling problems that affect other repair methods. Furthermore, it can also be seen that it would be desirable to provide a method of repairing uneven sections of existing concrete slabs that would be capable of lifting large sections of the slabs in a manner that does not require mechanical heavy lifting apparatuses and that would be highly portable and capable of operating independently from outside power sources.

SUMMARY OF THE INVENTION

It is the primary objective of the present invention to provide a method of repairing existing concrete slabs that have become uneven and damaged due to settling or other changes in the elevation of the earth upon which they are built.

It is an additional objective of the present invention to provide a means of repairing damaged sections of concrete slabs which utilizes lime sludge as a fill material that is not susceptible to the settling propensities that are common in the materials used in the prior art.

It is an further objective of the present invention to provide such a method of repairing concrete slabs which is highly portable and capable of operating independently from all external power sources and which is economical and efficient in its operation.

It is a still further objective of the present invention to provide such a method of repairing slabs which is capable of operation in conjunction with concrete slabs varying in size from the relatively small section of concrete sidewalks to the huge concrete slabs that are commonly used in such things as freeways and airport runways.

These objectives are accomplished by the use of a concrete slab leveling system that employs lime sludge as a fill material which is a mixture of calcium, magnesium, and water that is a common byproduct of water softening processes. Additionally, the chemical makeup of the lime sludge is similar to that of mortar and cement and provides similar structural integrity properties when dried. The use of the lime sludge imparts these cement-like qualities to the fill when dried while retaining the fluid qualities when fully hydrated that allows for its easy pumping through hoses and other components used in these operations. Additionally, the use of the lime sludge improves the lift characteristics of the fill material due to its viscous nature allowing a concrete slab to be easily lifted even when there is little or no settle cavity between the concrete slab and the underlying ground.

The delivery of the fill material to the targeted area beneath a damaged concrete slab is accomplished by the use of an apparatus that is built upon a vehicle such as a flatbed truck or trailer which makes it highly transportable enabling the invention to move from site to site quickly and easily. The flatbed platform of the vehicle provides the point of attachment for the material bin which is a relatively large opened topped rectangular box which holds the fill material that is to be pumped under the targeted concrete slab. The material bin has an interior that is constructed with downward diagonally oriented sides that form a V-shape. This manner of construction directs fill material towards the auger channel located at the bottom center of the bin's interior.

The auger channel is an open top box that extends the length of the lower surface of the bin's interior and which contains the auger itself. The auger is a screw-like device which is rotationally driven by the bidirectional auger motor on the most forward surface of the exterior of the bin. The auger serves to move the fill material contained within the bin towards the front of the auger channel during operations so that it can be moved efficiently into the pump assembly. The pump assembly draws the provided fill material from the bin and delivers it under pressure to the tool hose which in turn is employed to deliver the fill material to the desired location.

The pump assembly performs this function by the use of a plurality of hydraulic type cylinders that are tied together through the use of a pump cap attached to the upper ends of the cylinder's rams. One of these cylinders is hydraulically activated and operated by an independent hydraulic system that is contained within the body of the flatbed transport vehicle. The operation of the pump is accomplished by the expansion of the hydraulic cylinder through the activation of the hydraulic manifold controls which forces its ram upwards thereby pushing the pump rod cap upwards. By virtue of the cap's tie to the plurality of operational cylinder rams, the operational cylinders are also expanded.

The expansion of the operational cylinders draws the fill material from their interiors from the pump manifold which ties the pump assembly to the material bin. The pump manifold is equipped with two one-way valves which control the flow of the fill material within the pump assembly. The first of these valves, the forward one-way valve, lies between the interior of the bin and the pump manifold and functions to allow the flow of fill material into the manifold as the cylinders are expanded. Conversely in this operation the rearward one-way valve lies between the pump manifold and its outlet the manifold pipe and functions to keep fill in the manifold pipe from being drawn back into the pump manifold.

Once the expansion of the hydraulic cylinder is complete and the operational cylinders are full, the hydraulic cylinder is then contracted which forces the fill within the operational cylinders back into the pump manifold. This reversal of flow closes the forward one-way valve thereby blocking the flow of the fill back into the bin and opens the rearward one-way valve allowing the fill to be forced into the manifold pipe and to a delivery mechanism to be forced under a settled section of concrete slab. Additionally, the use of the pump assembly in conjunction with the fill material provides enough pressure at the point of delivery to elevate even the largest concrete slab in common use today.

These components of the pump apparatus function together to facilitate the repair of a damaged concrete slab in the following manner. First, once the targeted section of cement slab has been identified, dried mason's sand is blown under the slab under high pressure. This process serves to fill in any existing settle cavities in preparation for the slab raising procedure. With this complete, an operator drills a hole through the slab in a position that is roughly in its center. Once this has been accomplished, the nozzle portion of the injector gun is forced into this hole which forms a seal between the gun nozzle and the concrete slab. The operator then opens and closes the control handles which sends a flow of the lime sludge under pressure through the gun nozzle. The pressurized lime sludge is thus forced between the concrete slab and underlying ground. The continual build up of the lime sludge beneath the concrete slab places upward pressure on the lower surface of the damaged concrete slab. This upwards pressure slowly raises the concrete slab until it reaches a point at which it is level with the remaining neighboring slab.

Once the concrete slab has been lifted by the process described above, the nature of the lime sludge leaves some open space in the settle cavity between the lower surface of the concrete slab and the surface of the ground. This is a result of the viscous nature of the fill material as it does not need to fill the entire settle cavity before lifting the slab. This characteristic of the material fill allows the user to pack the remaining open space with dried mason's sand which, because of its stable nature, further solidifies the repair. The sand fill is accomplished by drilling more holes into the slab and injecting the sand into the openings. Once these processes have been completed, the open holes in the concrete slab are filled in with an appropriate material to complete the repair of the concrete slab.

For a better understanding of the present invention reference should be made to the drawings and the description in which there are illustrated and described preferred embodiments of the present invention.

DESCRIPTION OF THE DRAWINGS

FIG. 2 is a side elevation view of the injector gun component used in conjunction with the present invention illustrating its manner of construction and the orientation of its major components.

FIG. 3 is a side elevation cutaway view of the material bin component used in conjunction with the present invention and illustrates the relationship between the material bin, the auger, and the pump assembly which are pivotal to the delivery of the fill material.

FIG. 6 is a side elevation cross sectional view of a section of typically damaged concrete slab in which one portion has settled into the underlying earth.

FIG. 7 is a side elevation cross sectional view of a section of typically damaged concrete slab illustrating a settled portion which has been prepared for repair by the addition of a plurality of the gun nozzle holes through its body.

FIG. 8 is side elevation cross sectional view of a section of concrete slab which is being raised by the introduction of lime sludge into the settle cavity by the use of the injector gun component.

DESCRIPTION OF THE PREFERRED EMBODIMENT

Figure 1:
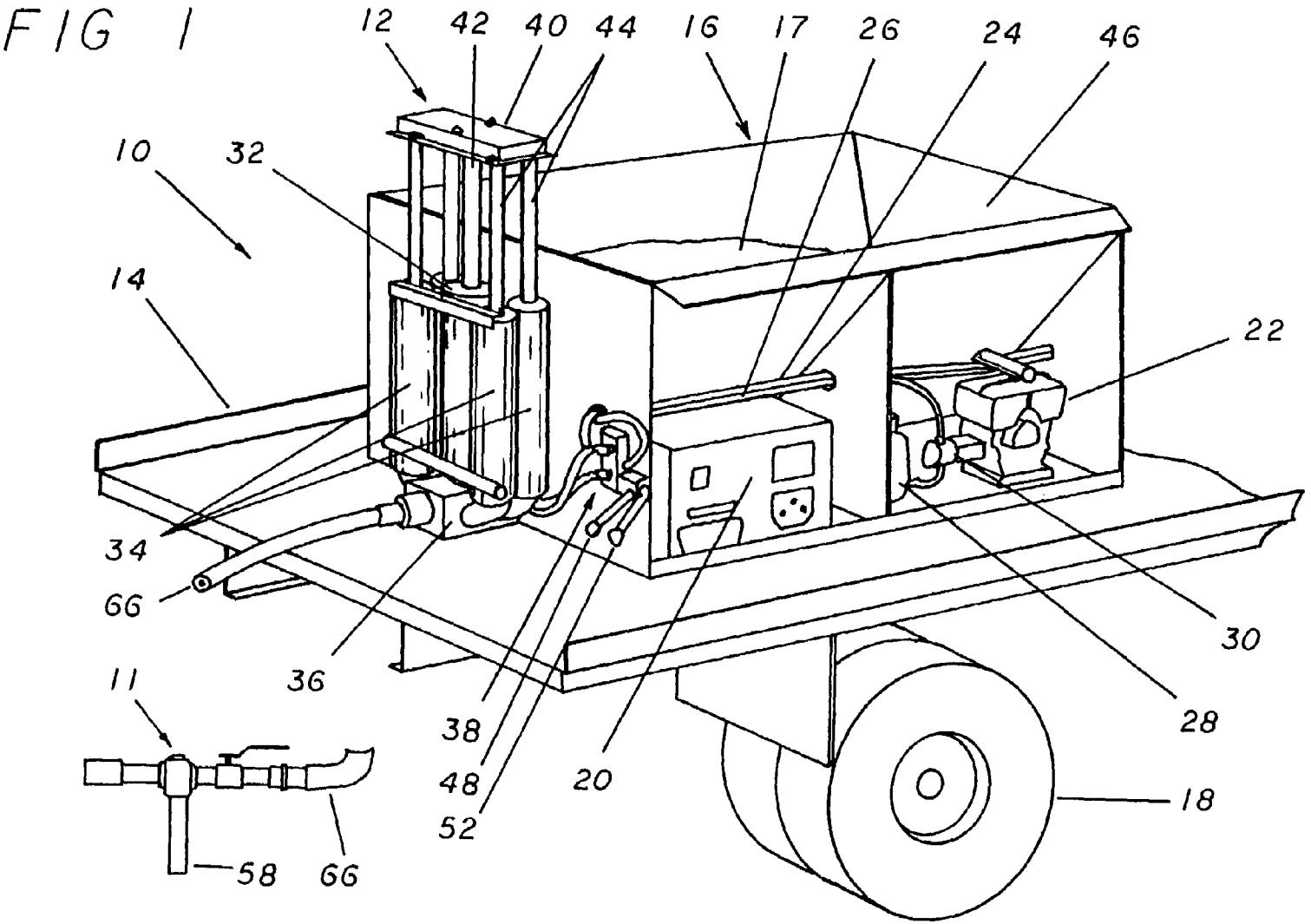
FIG. 1 is a perspective view of the flatbed and pump apparatus used in conjunction with the present invention which illustrates the positioning of the pump on a flatbed truck and the relative positions of its major components in relation to the flatbed.

Referring now to the drawings, and more specifically to FIG. 1, the present invention is employed to repair concrete slabs by making use of a plurality of devices to introduce lime sludge 17 in the desired location. The first of these is a slab lift pump apparatus 10 which is a self contained portable device that is employed to pump at pressure the lime sludge 17 through the connected tool hose 66. The portable aspect of the slab lift pump apparatus 10 is accomplished by placing its components on a flatbed 14 vehicle that is equipped with a set of wheels 18 such as a truck or trailer. Additionally, all of the components of the slab lift pump apparatus 10 that are necessary for its operation are contained on the surface of the flatbed 14 which allows it to be quickly moved from site to site and to operate completely independently.

The slab lift pump apparatus 10 is made up of a large open topped fill container 16 within which the lime sludge 17 that is used to elevate the targeted concrete slabs is stored during operations. The fill container 16 has a bin interior 46 into which the lime sludge 17 is deposited. The rearward surface of the fill container 16 also serves as the mounting point for the pump assembly 12 which is the component of the slab lift pump apparatus 10 employed to move the lime sludge 17 from the bin interior 46 to the tool hose 66 and thus, to the targeted repair area.

The flatbed 14 also provides a place of securement for additional ancillary components of the slab lift pump apparatus 10 that are necessary for its operation and which allow it to be operated independently. The first of these is the generator unit 20 which is an electric generator that can be employed to power electrical tools such as hand held drills that may be necessary for the lift operation. Additionally, the power unit 22, which is an internal combustion engine that primarily powers the hydraulic pump 30 to which it is attached, is also positioned along the fill container 16 and which draws hydraulic fluid from the fluid reservoir 28 and supplies the necessary hydraulic pressure to the remaining components of the slab lift pump apparatus 10 through the primary hydraulic pressure and return lines, 24 and 26.

The hydraulic fluid necessary to operate the system is stored and supplied by the fluid reservoir 28 which is connected to the hydraulic pump 30. The hydraulic motor 30 forces the hydraulic fluid under pressure through the primary hydraulic pressure line 24 which in turn is connected to the hydraulic control manifold 38 mounted on the exterior of the fill container 16. The hydraulic control manifold 38 is used to control the flow of hydraulic pressure to the other operational components of the slab lift pump apparatus 10.

In furtherance of this purpose, the hydraulic control manifold 38 is equipped with the hydraulic cylinder control handle 48 and the auger drive control handle 52 which are employed to control the flow of hydraulic pressure to their respective components by opening and closing valves contained within its casing. Therefore, the activation of the auger drive control handle 52 supplies hydraulic power to the auger drive motor 50 which in turn drives the auger 72 in a rotational manner (both of which will be described in greater detail below). The hydraulic cylinder control handle 48 in similar manner supplies hydraulic pressure to the primary hydraulic system to operate the hydraulic motor 30.

The construction of the injector gun 11 is further detailed in FIG. 2 which illustrates its relative components in relation to the present invention. The injection gun 11 is made up of a vertically oriented gun nozzle 58 which is the component which engages the concrete slab and delivers the lime sludge 17. The gun nozzle 58 is connected at its upper end to the lower surface of the nozzle manifold 60 which is a T-like apparatus having connected to its forward end a pressure outlet valve 56 which can be used to relieve unneeded pressure contained within the injector gun 11. The rearward side of the nozzle manifold 60 is connected to the gun pipe 70 which forms the majority of the horizontal portion of the injector gun 11. The gun pipe 70 also contains the flow valve 62 which can be used to control the flow of lime sludge 17 to the gun nozzle 58 by the operation of the connected valve handle 64. Finally, the gun pipe 70 is connected at its most rearward end to the hose connector 68 which is in turn connected to the lead edge of the tool hose 66 which supplies the lime sludge 17.

The construction of the fill container 16 and its connection to the associated components of the slab lift pump apparatus 10 are further illustrated in FIG. 3. As previously stated, the fill container 16 is the component of the invention that is used to hold the lime sludge 17 during operations and is generally described as an open topped rectangular box having bin forward and rearward walls, 78 and 80, and the two bin diagonal sides 76 defining the bin interior 46. The bin diagonal sides 76 are both angled inwards from their upper edges at the top of the bin interior 46 to their terminus at the upper most edge of the vertical sides of the auger channel 74 located at the bottom center of the bin interior 46. The auger channel 74 is a relatively square in cross-section component which houses the auger 72 and forms the bottom of the bin interior 46. The primary purpose of the auger channel 74 is to ensure that the lime sludge 17 contained within the fill container 16 is always in contact with the auger 72 so that it can be moved to the pump assembly 12. The auger 72 itself is a screw-like device which, by the rotational force applied through the auger drive motor 50, is employed to move the fill to the pump assembly 12 and to keep the fill mixed. Additionally, the bin diagonal sides 76 and the auger channel 74 are also lined with a heavy gauge plastic bin liner 82 that helps keep the lime sludge 17 from sticking to the bin interior 46 and ensuring that it will move down into the auger channel 74.

At the forward end of the fill container 16, the auger channel 74 is connected to the pump manifold 36 of the pump assembly 12 through the manifold inlet 90. This supplies lime sludge 17 to the interior of the pump manifold 36 through the forward one-way valve 84 which is employed to control the flow of lime sludge 17 and which will be discussed in greater detail below. At this point, the hydraulic action of the pump assembly 12 and its components operate to pump the fill to the desired location to effectuate the desired repair.

Figure 5:
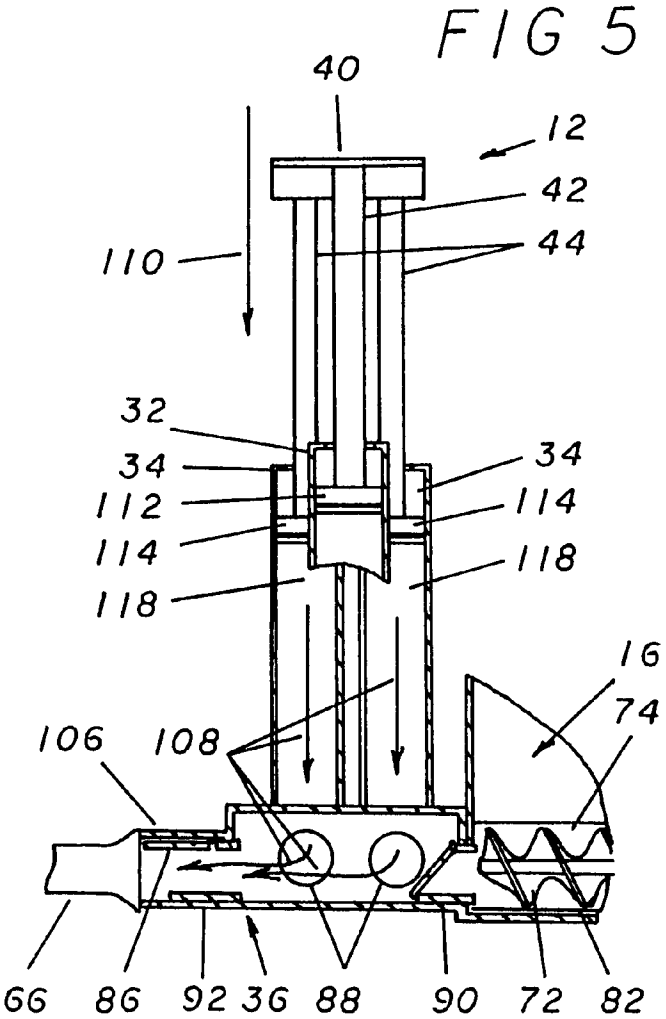
FIG. 5 is a is a side elevation cutaway view of the pump assembly component used in conjunction with the present invention illustrating the manner by which lime sludge is forced through the manifold and into the manifold pipe during the operation of the pump.
Figure 4:
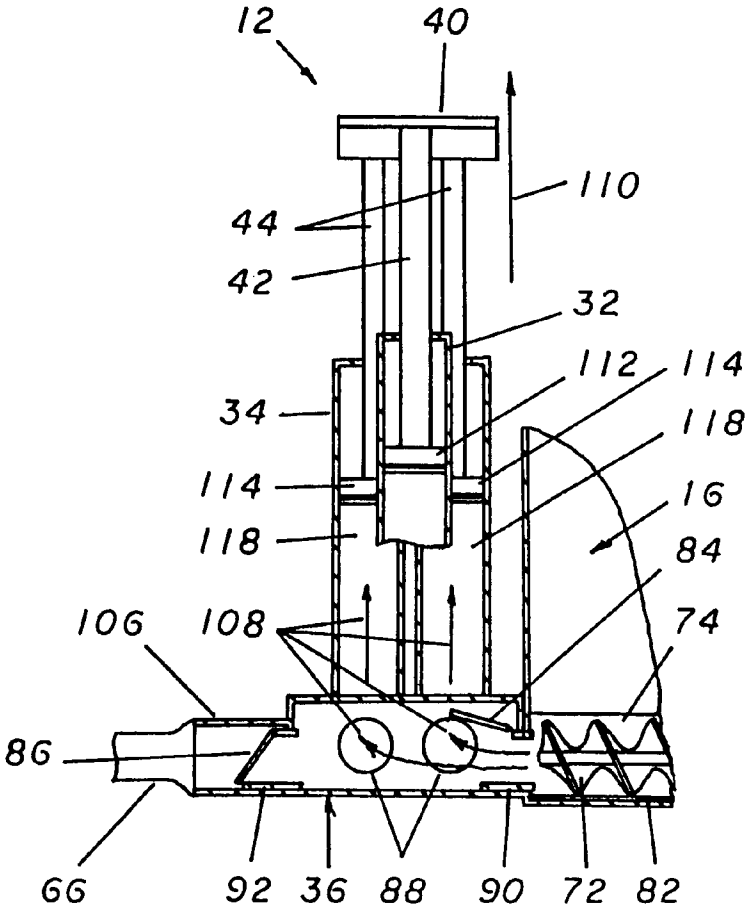
FIG. 4 is a side elevation cutaway view of the pump assembly component used in conjunction with the present invention illustrating the manner by which lime sludge is drawn from the bin into the pump assembly during its operation.
Figure 9:
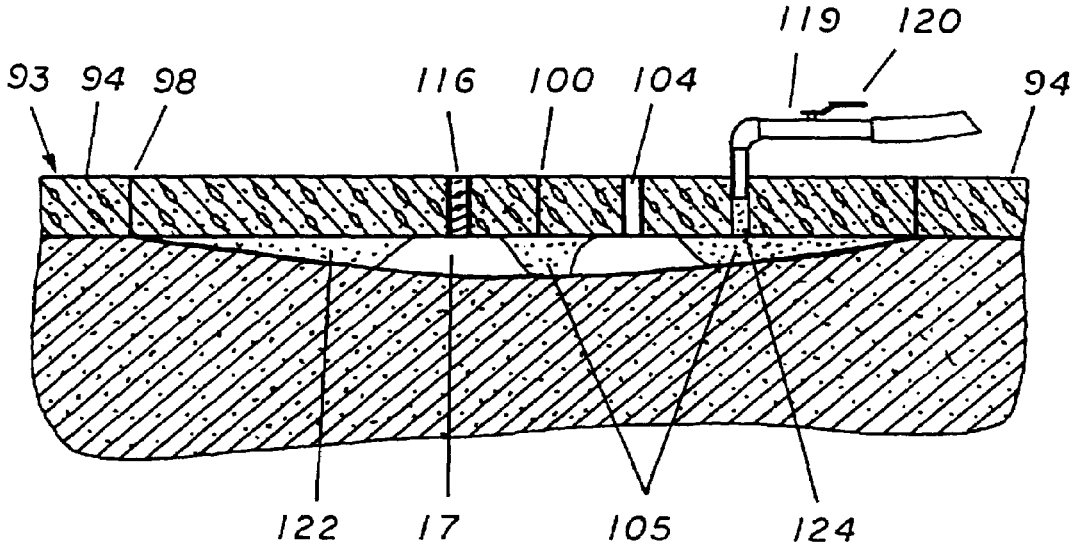
FIG. 9 is side elevation cross sectional view of a section of concrete slab which has been raised by the introduction of lime sludge and illustrating the method used to inject mason's sand into the remaining portions of the settle cavity to complete the repair.

The manner in which the pump assembly 12 operates is further illustrated in FIGS. 4 and 5. The expansion of the primary hydraulic cylinder 32 through the hydraulic fluid forcing the internal primary cylinder piston 112 upwards, in turn forces the pump rod cap 40 in a mirroring upward motion defined by the cylinder movement arrow 110. This upward motion of the pump rod cap 40 also pulls up the operational cylinder rams 44 which in turn pulls up the connected operational cylinder pistons 114 contained within the operation cylinders 34. The upward motion of the operational cylinder pistons 114 creates a partial vacuum within the operational cylinders 34 which serves to act on the fill within the system imparting material flow 108 which acts to load up the operation cylinder interiors 118 through the cylinder ports 88. The material flow 108 also places upward pressure on the forward one-way valve 84 allowing the lime sludge 17 to move into the pump manifold 36. Additionally, the material flow 108 in this configuration places downward pressure on the rearward one-way valve 86 which effectively closes off the manifold outlet 92 which keeps any material rearward of it from being drawn back into the interior of the pump manifold.

Conversely, when the primary hydraulic cylinder 32 is contracted, it pulls the pump rod cap 40 in a downward motion indicated by the cylinder movement arrow 110 which in turn pushes the operational cylinder pistons 114 downward. This downward movement forces the lime sludge 17 contained within the operational cylinder interiors 118 back into the pump manifold 36 as illustrated again by the material flow 108 arrows. The reversal of the material flow 108 has the opposite effect on the forward and rearward one-way valves, 84 and 86. That is to say, the material flow 108 in this configuration places downward pressure on the forward one-way valve 84 sealing off the manifold inlet 90 thereby keeping the lime sludge 17 from being forced back into the fill container 16. Conversely, the material flow 108 opens the rearward one-way valve 86 allowing the lime sludge 17 to exit the pump manifold 36 and enter the manifold pipe 106 and repaired nozzle hole 116 to be delivered in the desired location.

The manner in which this equipment (or other similar equipment) is employed to deliver the lime sludge 17 to the desired location in the repair process is illustrated in FIGS. 6, 7, 8, and 9. FIG. 6 illustrates the typical situation in which a damaged slab 96 exists which has in whole or in part settled into the underlying ground 102 below the normal position of a level concrete slab 94. This situation normally results in a centrally located slab crack 100 and slab gaps 98 located on damaged slab's 96 outer edges. This situation creates a potentially dangerous variance in the heights of neighboring concrete slabs 93 which must be repaired.

The repair process of the present invention is commenced by initially filling any existing settle cavities 105 between a damaged slab 96 and the underlying ground 102. This operation can be accomplished by inserting a sand fill nozzle 119 in an existing gap between the damaged slab 96 and the surrounding ground 102 or by drilling a sand nozzle hole 124 through the damaged slab 96 in an appropriate location and inserting the sand fill nozzle 119 through the sand nozzle hole 124, thus, gaining access to any existing settle cavity 105. The fact the mason's sand is blown into the settle cavity at very high pressures ensures that it will be dispersed to fill in any such settle cavities even if they are located at a relatively great distance from the sand nozzle hole 124.

Once the existing settle cavities have been filled by the above described manner, the operator proceeds with the repair process by drilling an appropriate number of a gun nozzle holes 104 thought the damaged slab 96 as illustrated in FIG. 7. The number of these gun nozzle holes 104 that are required to perform the desired repairs is determined by the severity of the existing damage and the size damage slab 96 that these repairs are being performed on. The drilling of the gun nozzle holes 104 provides the user with access to the slab/ground interface 107 between the damaged slab 96 and the ground 102. Upon completion of this step, the gun nozzle 58 of the injector gun 11 is secured within the gun nozzle hole 104 and the operator engages the injector gun 11 by providing pressurized lime sludge 17 to the delivery components to force it between the lower surface of the damaged slab 96 and the ground 102.

The effect of this injection of the lime sludge 17 is to lift the damaged slab 96 off of the underlying ground 102 which serves to open up additional settle cavities 105. The settle cavities 105 are partially filled by the lime sludge 17 which also places an upward force on the lower surface of the damaged slab 96. This upward force is a function of the nature of the lime sludge 17 as at some point in the pumping process, the tendency of the lime sludge 17 to spread in an outward manner is less than its tendency to spread upward. It is this tendency for the lime sludge 17 to spread upward that is exploited to provide the required lifting of the damaged slab 96.

The lifting process described above is continued until the upper surface of the damaged slab 96 is raised to a point where it is level with the surrounding concrete slab 93 as illustrated in FIG. 8. Once this has been accomplished, the injector gun 11 is removed from the gun nozzle hole 104 which is then filled in to produce a repaired nozzle hole 116 which is formulated to match the surrounding surface of the damaged slab 96. This process leaves some existing open space in the settle cavity 105 which is addressed in the final step of the process.

After the damaged slab 96 has been restored to its proper orientation, additional sand nozzle holes 124 are drilled through the body of the damaged slab 96 to allow for the insertion of a sand fill nozzle 119 which is employed to fill the remaining settle cavity 105. The mason's sand 122 is delivered under air pressure by a device in common use in the industry through the sand fill nozzle 119 which is controlled by the use of the sand nozzle handle 120. The mason's sand 122 is a perfect tool for this application as it is non-compatible and will therefore resist any further settling of the concrete slab 93. Thus, the present invention provides a method of repairing damaged concrete slabs 93 in a manner that results in a long lasting repair that can be effectuated at lower cost and greater efficiency than was previously available.

Although the present invention has been described in considerable detail with reference to certain preferred versions thereof, other versions are possible. Therefore, the spirit and scope of the appended claims should not be limited to the description of the preferred versions contained herein.

What is claimed:

1. A method of raising and leveling a settled slab which comprises the steps of:

(a) mixing a quantity of lime and liquid into a viscous lime sludge such that said lime sludge consists primarily of lime and water;

(b) cutting a plurality of holes in said settled slab;

(c) pumping said lime sludge under said settled slab through said holes so as to move said settled concrete slab;

(d) leveling said settled concrete slab by controlling said pumping of said lime sludge pumped under said settled slab;

(e) stabilizing said slab with a mixture of well dried sand and compressed air pumped beneath said slab so as to fill any voids with said well dried sand; and (f) repairing said plurality of holes in said slab.

2. A method of raising and leveling a settled slab as in claim 1 wherein said lime sludge is an aqueous solution of an inorganic salt selected from the group consisting of calcium chloride, magnesium chloride, and aluminum sulfate obtained from water treatment.

3. A method of raising and leveling a settled slab as in claim 1 wherein said plurality of holes are repaired with patch material of similar composition and appearance of said concrete slab.

4. A method of raising and leveling a settled slab as in claim 1 wherein said slab is comprised of concrete.

5. A method of raising and leveling a settled slab which employs the use of lime sludge as a lifting agent comprising the steps of:

(a) mixing a quantity of lime and liquid into a viscous lime sludge such that said lime sludge consists primarily of lime and water;

(b) cutting a plurality of holes in said settled slab;

(c) pumping said lime sludge under said settled slab at high pressure so as to move said settled slab;

(d) raising and leveling said settled slab by controlling said pumping of said lime sludge pumped under said settled slab;

(e) pumping a mixture of compressed air and well dried sand beneath said raised and leveled slab; and (f) repairing said plurality of holes in the said slab.

6. A method of raising and leveling a settled slab as in claim 5 wherein said mixture of well dried sand and compressed air pumped beneath said slab is used to fill any voids with sand so as to stabilize said slab.

7. A method of raising and leveling a settled slab as in claim 6 wherein said mixture of compressed air and well dried sand is pumped under high pressure into said voids along the sides of said raised and leveled slab.

8. A method of raising and leveling a settled slab as in claim 7 wherein said plurality of holes are repaired with patch material of substantially the same composition and appearance of said concrete slab.

9. A method of raising and leveling a settled slab as in claim 8 wherein said slab is comprised of concrete.

10. A method of raising and leveling a settled concrete slab which employs the use of lime sludge as a lifting agent comprising the steps of:

(a) mixing a quantity of lime and liquid into a viscous lime sludge such that said lime sludge consists primarily of lime and water;

(b) cutting a plurality of holes in said settled concrete slab;

(c) pumping said lime sludge under said settled concrete slab at high pressure;

(d) leveling said settled concrete slab by controlling said pumping of said lime sludge pumped under said settled concrete slab;

(e) cutting a plurality of sand holes in said settled concrete slab;

(f) pumping an air and sand mixture of compressed air and well dried sand beneath said settled concrete slab; and (g) repairing said plurality of holes in the said concrete slab.

11. A method of raising and leveling a settled concrete slab as in claim 10 wherein said concrete slab is stabilized with a mixture of well dried sand and compressed air pumped beneath said concrete slab so as to pack any voids with said well dried sand 12. A method of raising and leveling a settled concrete slab as in claim 11 wherein said well dried sand and compressed air mixture is pumped into said voids through said sand holes.

13. A method of raising and leveling a settled concrete slab as in claim 12 wherein said plurality of holes are repaired with patch material of substantially the same composition and appearance of said concrete slab.

14. A method of raising and leveling a settled concrete slab as in claim 13 wherein said plurality of sand holes are repaired patch material of substantially the same composition and appearance of said concrete slab.

* * * * *